United States Patent [19]

Kolb

[11] 4,167,082

[45] Sep. 11, 1979

[54] AUTOMATICALLY CONTROLLABLE PROJECTING CONTOUR GRINDING MACHINES

[76] Inventor: Alfred Kolb, Haus am Tannenberg, 6980 Wertheim am Main, Fed. Rep. of Germany

[21] Appl. No.: 852,669

[22] Filed: Nov. 18, 1977

[30] Foreign Application Priority Data

Dec. 1, 1976 [DE] Fed. Rep. of Germany ..... 2654404

[51] Int. Cl.[2] ..... B24B 49/12

[52] U.S. Cl. ..... 51/165.72

[58] Field of Search ..... 51/165 R, 165.71, 165.72

[56] References Cited

U.S. PATENT DOCUMENTS

| | | | |
|---|---|---|---|
| 2,485,355 | 10/1949 | Brennan | 51/165.72 |
| 3,507,075 | 4/1970 | Schmidt | 51/165.72 |
| 3,619,617 | 11/1971 | Kolb | 51/165.72 |
| 3,670,460 | 6/1972 | Oldfield | 51/165.72 |
| 4,027,245 | 5/1977 | Bourrat | 51/165.71 |

*Primary Examiner*—Harold D. Whitehead

*Attorney, Agent, or Firm*—Hauke and Patalidis

[57] ABSTRACT

An automatically controllable projecting contour grinding machine comprising a grinding disc support, a grinding disc, actuator elements, an optical projection device, a projection surface, numerical control means, and a marking, wherein said grinding disc support is displaceable along two mutually perpendicular axes, said actuator elements are arranged to manually displace said grinding disc support, and said numerical control means automatically controls displacement of said grinding disc support, said optical projection device forming an image of said grinding disc and of a workpiece to be machined on said projection surface, and said marking being provided on said projection surface and indicating the starting position of said grinding disc.

8 Claims, 7 Drawing Figures

AUTOMATICALLY CONTROLLABLE PROJECTING CONTOUR GRINDING MACHINES

BACKGROUND OF THE INVENTION

1. Field of the Invention

The invention relates to automatically controllable projecting contour grinding machines. Such a machine may have a grinding disc support which is displaceable along two mutually perpendicularly disposed axes, with manual actuator elements for displacing this support, and with an optical projection device for throwing an image of the grinding disc and the workpiece to be machined on to a projection surface.

2. Description of the Prior Art

In known projecting contour grinding machines, an image of the grinding disc and an image of the workpiece are produced in an enlarged form on a projection desk, so that the engagement location of the grinding disc can be observed accurately. On the projected image, a transparent carrier has drawn thereon the desired contour line on an appropriately enlarged scale, that is to say the desired contour of the workpiece. By means of a manual control, for example two hand wheels, the grinding disc is displaced, for example on a compound slide rest, in such a manner that the image of the grinding disc on the projection screen follows exactly the desired contour line. Thereby the desired contour is ground into the workpiece at a correspondingly reduced scale. The accuracies obtainable with such known projecting contour grinding machines lie in the order of magnitude of one thousandth of a millimeter, that is to say highly precise devices are involved.

In order to render automatic the displacement of the grinding disc during the machining process, it is already known to scan the desired contour line or a corresponding control line by means of a photocell and to use the movement thereof for controlling the grinding disc support. This control has the disadvantage that it is not well suitable for programmed operation of a projecting contour grinding machine.

SUMMARY OF THE INVENTION

According to the invention, there is provided an automatically controllable projecting contour grinding machine comprising a grinding disc support which is displaceable along two mutually substantially perpendicular axes, actuator elements for manually displacing the support, an optical projection device for forming an image of the grinding disc and the workpiece to be machined on a projection surface, and numerical control means for automatically controlling the displacement of the support, a marking for the starting position of the grinding disc being provided on the projection surface.

Admittedly, it is known already to control numerically machine tools such as lathes and milling machines. However, transfer of such control to a projecting contour grinding machine is not possible in a straightforward manner. It is essential for numerical control that the tool and the workpiece are located in a certain mutually relative position prior to the start of the automatic control process, in order that the numerical control directs the movement of the support from a definite starting position. With the usual machine tools, it is relatively easy to measure, at the beginning of the working process, the relative position of workpiece and tool, for example by means of gauges. However, such relative positioning at the beginning of the control process is impossible in the case of projecting contour grinding machines with which working is effected with an accuracy of less than one thousandth of a millimeter.

The use of the numerical control for projecting contour grinding machines is rendered possible by providing a reference marking for the grinding disc image on the projection screen to indicate the position of the grinding disc image and thus of the grinding disc relative to a desired contour line before the start of the control process.

This marking may correspond to the contour of a grinding disc image when mounted on the grinding machine.

DESCRIPTION OF THE EMBODIMENTS

Figure 1:
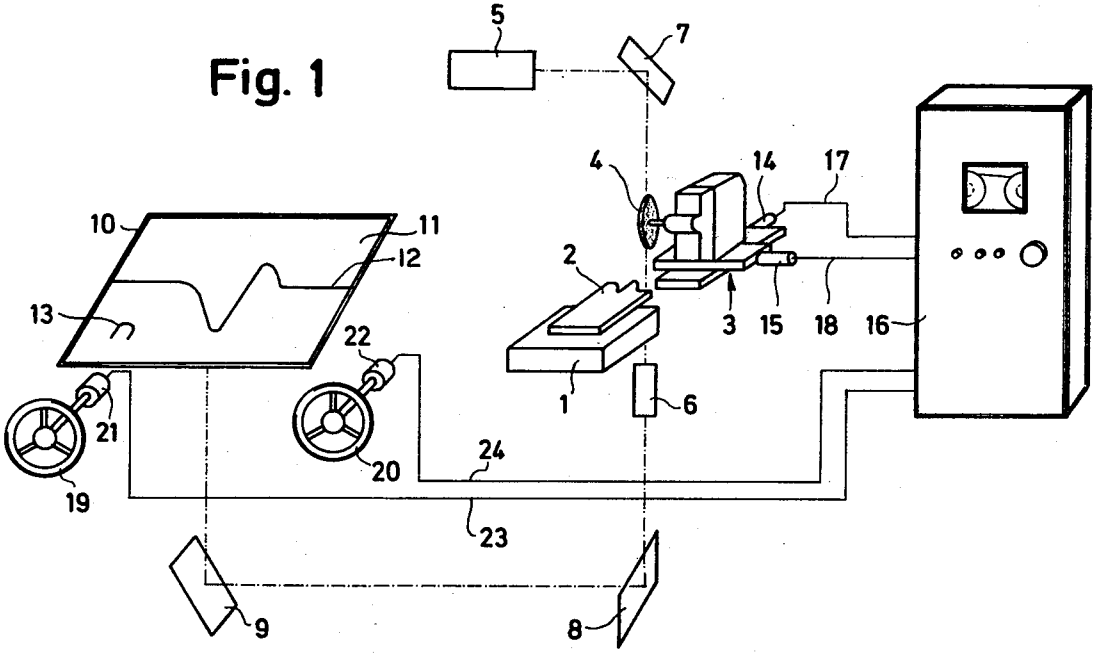
FIG. 1 is a simplified diagrammatic view of a preferred numerically controlled projecting contour grinding machine.
Figure 2:
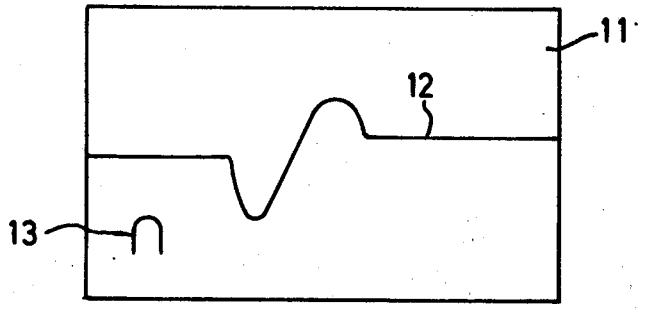
FIG. 2 is a view from above of a carrier which may be placed over a projection screen.

The projecting contour grinding machine is provided with a workpiece 2 which is fixed on a support 1 and which is machined by a grinding disc 4 which is mounted on a compound slide rest 3 (FIG. 1). The engagement location of the grinding disc 4 at the workpiece 2 is projected onto a projection screen 10 by means of a projector device which comprises a light source 5, a lens 6, and deflecting mirrors 7, 8 and 9. A transparent carrier 11, which is provided with a desired contour line 12, (FIGS. 1 and 2) and a grinding disc marking 13, is placed over the projection screen 10.

In the illustrated constructional example, the grinding disc marking 13 has the same shape as the image 4' (FIGS. 3 and 4) of the grinding disc formed on the projection surface.

For displacing the grinding disc 4 relatively to the workpiece 2, the compound slide rest is provided with two adjuster motors 14 and 15 which are illustrated merely diagrammatically. These may be constructed, for example, as stepping motors or as servo motors. Each of the two adjuster motors is responsible for the displacement of the grinding disc in one direction. The two adjuster motors are controlled and operated by a numerical control of a construction known per se and illustrated summarily in FIG. 1 in the form of a control box 16. The adjuster motors 14 and 15 are connected to the control box 16 by means of leads 17 and 18, respectively.

Figure 5:
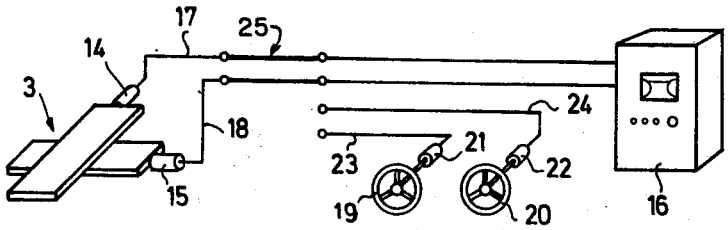
FIG. 5 is a diagrammatic circuit arrangement for operating the projection contour grinding machine by means of the numerical control.
Figure 6:
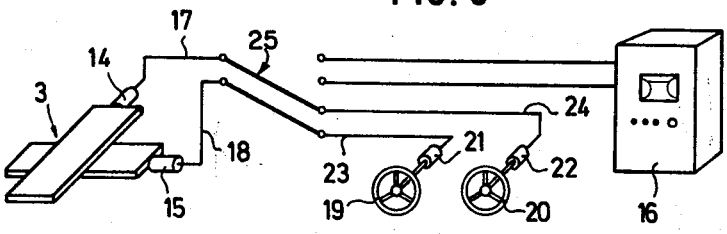
FIG. 6 is an arrangement similar to FIG. 5 with a purely manual control.

Two manual actuator elements, in the constructional example two hand wheels 19 and 20, are disposed in the vicinity of the projection screen 10 in such a manner that an operator may have the projection screen 10 in view during rotation of the hand wheels 19 and 20. Each of the hand wheels actuates one of the angle step transmitter 21 and 22 which are likewise connected to the control box 16 by means of leads 23 and 24, respectively. The control box 16 comprises switches which are not illustrated at FIG. 1 of the drawing and by means of which, as is illustrated diagrammatically at 25 in FIGS. 5 to 7, either only the numerical control, or only the angle step transmitters 21 and 22 associated with the hand wheels 19 and 20, respectively, or both the numerical control and the angle step transmitters 21 and 22 may be connected to the adjuster motors 14 and 15, respectively, by way of the leads 17 and 18.

Figure 3:
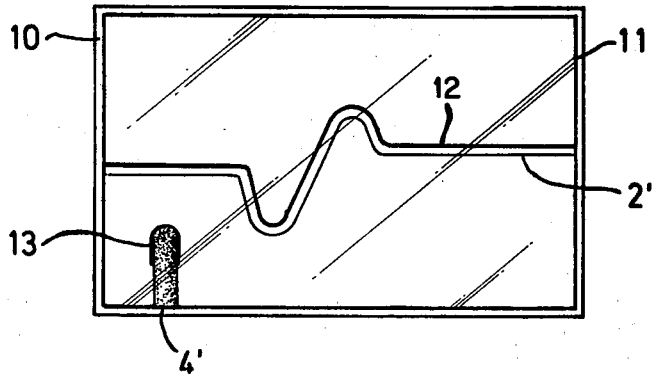
FIG. 3 is a view from above of the projection screen of FIG. 1 with the grinding disc positioned in the starting position for the numerical control.
Figure 4:
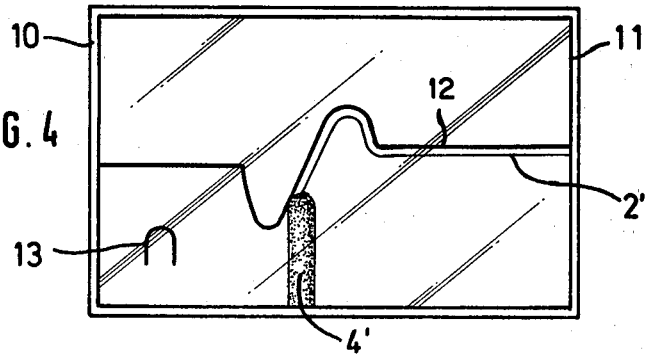
FIG. 4 is a view from above of the projection screen during the course of the operation.

In use of the projecting contour grinding machine first a carrier 11 with the desired contour line 12 and the grinding disc marking 13 is placed over the projection screen 10. Then the pre-formed workpiece 2 is securely attached to the support 1 in such a manner that its contours 2' appear on the projection screen below the desired contour line 12 (FIGS. 3 and 4). The grinding disc 4, and thus the grinding disc image 4', is then positioned relatively to the workpiece 2 and the workpiece image 2', respectively. For this purpose the angle step transmitters 21 and 22 are connected to the adjuster motors 14 and 15 by way of the switch 25 in the manner illustrated in FIG. 6 so that displacement of the grinding disc occurs upon rotation of the hand wheels 19 and 20. The grinding disc 4 is so positioned that it coincides accurately with the grinding disc marking, that is to say the marking forms the contour of the grinding disc image. The grinding disc 4 is then located in the starting position 13 (FIG. 3) for which the numerical control is programmed. The connections are then switched by means of the switch 25 in accordance with the illustration in FIG. 5 in such a manner that the adjuster motors 14 and 15 are connected to the numerical control 16. The latter is then set in operation in a known manner and displaces the grinding disc from the starting position to the machining position. At the same time, machining of the workpiece by the grinding disc may be observed on the projection screen 10, the grinding disc image travelling accurately along the desired contour line 12. If the machining proceeds correctly the edge of the treated workpiece and the desired contour line coincide on the projection screen.

Figure 7:
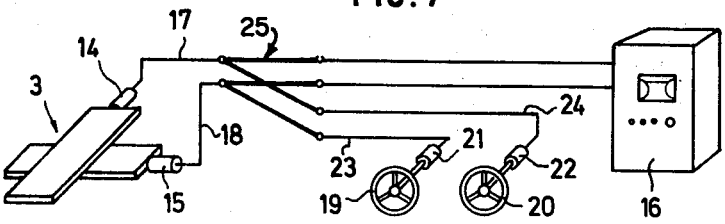
FIG. 7 is an arrangement similar to FIG. 6 with simultaneous numerical control and manual control.

If, in this manner of machining, deviations occur from the desired contour, which may be due for example to wear of the grinding disc, the apparatus is transferred to the switching state illustrated in FIG. 7, that is to say the adjuster motors 14 and 15 are connected simultaneously to the numerical control and to the associated angle step transmitters. It is possible thereby to superimpose a further control signal on the numerical control by manual actuation of the wheels 19 and 20, so as to effect the movement of the grinding disc on the basis of the numerical control and in addition thereto an intentional further movement of the grinding disc by actuation of the wheels 19 and 20. Thereby any deviations from the desired contour line which may occur can be corrected at once even during the machining process.

A particular advantage of the preferred projecting contour grinding machine resides in the fact that wear effects of the grinding disc are largely compensated in that prior to each new machining operation the grinding disc is positioned in the starting position, at the same time substantially perfect coincidence of the grinding disc image 4' and the grinding disc marking 13 on the projection screen being effected. This ensures that during the next following machining process the start is made from the actual grinding disc surface and not from the original one, even after wear of the grinding disc.

Due to the fact that the initial adjustment of the grinding disc can be performed very accurately owing to the high enlargement of the grinding disc image on the projection screen, it is possible to perform numerical control of the grinding disc with the required accuracy. This is because only the starting point of the control is adjustable with the necessary precision.

I claim:

1. An automatically controllable projecting contour grinding machine comprising a grinding disc, a workpiece supported for contour machining by said grinding disc, cross slide means displacing said grinding disc and said workpiece relative to each other along two mutually perpendicular axes, manual actuator means for displacing said cross slide means along said axes, numerical control means for automatically displacing said cross slide means along said axes, an optical projection device forming on a projection surface a magnified image of said grinding disc and of said workpiece to be machined thereby in accordance with a predetermined contour line, a transparent carrier on said projection surface having said predetermined contour line and a marking in the form of an enlarged outline of the grinding disc, wherein said marking defines a starting position for said grinding disc programmed in said numerical control means for effecting machining of the workpiece along said predetermined contour line by said numerical control means after placing the image of said grinding disc at said marking by way of said manual actuator means.

2. The projecting contour grinding machine of claim 1 wherein the outline of said marking has a shape corresponding to the contour of said grinding disc appropriate for effecting said grinding machining by said numerical control means.

3. The projecting contour grinding machine of claim 1 wherein said cross slide means is operated by driving means actuable selectively by said manual actuator means and said numerical control means.

4. The projecting contour grinding machine of claim 3 wherein said driving means comprise adjuster motors.

5. The projecting contour grinding machine of claim 4 wherein said adjustor motors are stepping motors.

6. The projecting contour grinding machine of claim 4 wherein said adjustor motors are servo motors.

7. The projecting contour grinding machine of claim 4 wherein said manual actuator means are associated with angle step transmitters arranged to produce electrical signals for controlling said adjuster motors.

8. The projecting contour grinding machine of claim 4 wherein said adjuster motors are actuable by said numerical control means.

* * * * *